United States Patent [19]

Smith et al.

[11] 4,447,246

[45] May 8, 1984

[54] DIESEL FUEL

[75] Inventors: Clifford E. Smith; Harold W. Mark; Rector P. Louthan; Howard F. Efner, all of Bartlesville, Okla.

[73] Assignee: Phillips Petroleum Company, Bartlesville, Okla.

[21] Appl. No.: 494,831

[22] Filed: May 16, 1983

[51] Int. Cl.[3] ..... C10L 1/08; C10L 1/22; C10L 1/24

[52] U.S. Cl. ..... 144/57; 44/76; 123/1 A; 123/198 A

[58] Field of Search ..... 44/57, 76; 564/91; 260/455 A; 123/1 A, 198 A

[56] References Cited

U.S. PATENT DOCUMENTS

| | | | |
|---|---|---|---|
| 2,599,350 | 9/1949 | Rudel et al. | 260/132 |
| 2,614,914 | 6/1946 | Eby et al. | 44/57 |
| 2,685,502 | 5/1950 | Heisig | 44/57 |
| 2,847,419 | 8/1958 | Harman et al. | 260/313 |
| 2,877,749 | 3/1959 | Fox | 44/57 |
| 2,902,984 | 9/1959 | Fox | 123/1 |
| 3,464,551 | 9/1969 | Falvey | 209/166 |
| 3,853,775 | 12/1974 | Williams | 252/42.1 |
| 4,017,439 | 4/1977 | Beadle | 260/79.5 |
| 4,058,402 | 11/1977 | Stansbury et al. | 106/16 |
| 4,147,715 | 4/1979 | Tilles et al. | 260/455 A |
| 4,248,779 | 2/1981 | Sato et al. | 260/455 A |
| 4,269,785 | 5/1981 | Nash | 260/455 A |
| 4,281,016 | 7/1981 | Kursu et al. | 260/455 A |

OTHER PUBLICATIONS

Aldrich Chemical Company 1982 catalogue, p. 377.
Merck Index, 9th edition (1976), p. 245.

*Primary Examiner*—Charles F. Warren
*Assistant Examiner*—Y. Harris-Smith

[57] ABSTRACT

An improvement in the cetane number of diesel fuels is achieved through the addition of a small, but effective, amount of a dithiocarbamate or a sulfonamide.

12 Claims, No Drawings

DIESEL FUEL

This invention relates to liquid fuels for compression ignition engines. In particular, it relates to liquid fuels containing novel addition agents for improving their combustion characteristics in compression ignition engines. In one aspect, this invention relates to the operation of a diesel engine with a fuel having improved ignition characteristics. In another aspect, this invention relates to the operation of a diesel engine, the fuel containing a minor proportion of a dithiocarbamate or a sulfonamide or a mixture of the two as an ignition accelerator. In another aspect, this invention relates to a compression ignition engine fuel containing a small, but effective, proportion of a dithiocarbamate or a sulfonamide or a mixture of the two as an ignition accelerator.

For the satisfactory operation of compression ignition engines it is necessary that the fuel employed have the property of igniting readily when introduced into the compression chamber. In order to obtain a sufficiently short ignition delay period, it is customary to add to the fuel a compound which will function as an ignition accelerator. Compounds which have beem employed for this purpose include certain peroxides, aldehydes, organic sulfides, and the lower alkyl nitrates. Many of these compounds are unsatisfactory for reasons such as instability, the undesirable lowering of a flashpoint, and the considerable increase in carbon residue which they impart or their tendency to form corrosive gases in storage or in operation.

The following objects of this invention will be attained by the various aspects of this invention.

An object of the invention is to provide improved compression-ignition engine operation.

Another object of the invention is to provide improved diesel engine operation with a fuel having improved ignition characteristics.

Another object of the invention is to provide an improved disel engine fuel.

Another object of the invention is to provide improved diesel engine operation with a fuel combustion in which the ignition delay characteristic is shortened by the incorporation therein of an additive.

Other aspects, objects, and the several advantages of this invention will be apparent to those skilled in the art upon a study of the accompanying disclosure and the appended claims.

In accordance with my invention, an improved fuel for compression ignition engines of the diesel type is obtained by blending with a suitable diesel oil stock a small amount of an ignition accelerating compound.

The ignition accelerating compounds of the invention can be generally represented by the formula:

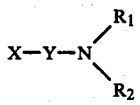

wherein X is an alkyl or alkylene (having one olefinic bond) group having one to six carbon atoms which can be normal, branched or cyclic; or an S-alkyl sulfenyl (R'—S—) where R' is an alkyl group having from one to six carbon atoms which can be normal, branched or cyclic chain; or a phenyl or p-tolyl group. $R_1$ and $R_2$ are independently selected from alkyl groups having one to six carbon atoms which can be normal, branched or cyclic; or a single R group joined together to form a saturated $C_5N$ ring; or $R_1$ can be nitroso and $R_2$ can be an alkyl having from 1 to 3 carbon atoms. Y is an $SO_2$ or a SC:S group.

One group of ignition accelerating compounds are N,N-dialkyldithiocarbamates of the structure

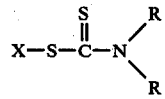

where R is an alkyl group of one to six carbon atoms which can be normal, branched or cyclic; or 2 R groups joined together to form a $C_5N$ saturated ring and X is an alkyl or alkylene (having one olefinic bond) group having one to six carbon atoms which can be normal, branched or cyclic; or an S-alkyl sulfenyl (R'—S—) where R' is an alkyl group having from one to six carbon atoms which can be normal, branched or cyclic. Representative examples of compounds falling within the above formula include allyl-N,N-dimethyl dithiocarbamate and t-butylsulfenyldimethyldithiocarbamate.

Another group of ignition accelerating compounds are N-alkyl-N-nitroso aryl sulfonamides of the structure

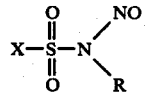

where R is an alkyl group having one to three carbon atoms and X is a phenyl or p-tolyl group. A representative example of these compounds falling within the above formula is n-methyl-n-nitroso-p-toluenesulfonamide.

The efficiency of operation of a diesel engine is materially improved when a fuel containing a minor amount of these accelerating compounds is burned in a combustion chamber of the engine. The compounds—either individually or in a mixture—are incorporated in the diesel fuel at sometime prior to injection into the combustion zone.

By the term diesel oil stock is meant such hydrocarbon oil fractions heavier than gasoline usually employed as fuels for compression ignition engines ordinarily having an initial boiling point in the upper part of the kerosine boiling range and an end boiling point in the heavy fuel oil range or boiling from about 350° F. to about 750° F. Although oil of the paraffinic type or hydrogenated oils are preferred for fueling compression-ignition engines, such fuels are generally more expensive and are not always available or practical. Diesel fuels giving satisfactory engine performance are formed from crude oils, gas oil, and residual oils having low pour point, low API gravity, and high heat value such as are procured from naphthenic base, asphaltic base, or mixed base stock.

Various other additives such as pour depressants, viscosity improvers, and other agents for improving combustion characteristics may be added to the oil, in addition to additives of the invention, in order to obtain a finished product of the desired characteristics.

The amount of the ignition accelerating agents of the invention employed depends upon the character of the base stock and on the effect desired. The amount present will be a sufficient amount necessary to improve cetane properties of the fuel. In general, the amount of these compounds employed will range from about 0.01 to about 2 wt. %, preferably from about 0.05 to about 1 percent by weight, although larger or smaller amounts may be used if desired.

This invention is exemplified by the following example which is not intended to unduly limit the invention.

EXAMPLE

The effectiveness of the compounds of the invention in increasing the octane number of diesel fuel is illustrated by comparing the cetane number of three base diesel fuels before and after adding about 0.2 weight percent of additive to each. The cetane numbers were determined by the procedure of the ASTM Committee D-2 on Petroleum Products and lubricants entitled "Tentative Method of Tests for Ignition Quality of Diesel Fuels by the Cetane Method", and designated as method D-613. The base fuels used were commercial diesel fuels having the properties set forth below. The improvement of cetane number of each base fuel is shown in the table below.

| Fuel | Cetane No. Increase |
|---|---|
| Base Fuel No. 1 plus 0.22 wt. % allyl-N,N—dimethyldithiocarbamate | 4.2 |
| Base Fuel No. 1 plus 0.25 wt % N,N—dimethyl-S—t-butyl sulfenyldithiocarbamate | 1.8 |
| Base Fuel No. 1 plus 0.61 wt % N,N—dimethyl-S—t-butyl sulfenyldithiocarbamate | 5.0 |
| Base Fuel No. 1 plus 0.24 wt % N—methyl-N—nitroso-p-toluenesulfonamide | 4.0 |
| Base Fuel No. 2 plus 0.24 wt % N—methyl-N—nitroso-p-toluenesulfonamide | 6.9 |
| Base Fuel No. 3 plus 0.24 wt % N—methyl-N—nitroso-p-toluenesulfonamide | 7.6 |

Properties of base diesel fuels used in the above tests:

| | Feed No. 1 | Feed No. 2 | Feed No. 3 |
|---|---|---|---|
| Gravity °API | 33.1 | 35.8 | 32.8 |
| Distillation Range | | | |
| IBP °F. | 249 | 386 | 302 |
| 10% °F. | 391 | 430 | 396 |
| 50% °F. | 519 | 506 | 512 |
| 90% °F. | 634 | 576 | 647 |
| EP °F. | 729 | 610 | 728 |
| Cetane No. | 42.3 | 47.5 | 41.7 |

We claim:

1. A method of operating a compression-ignition engine which comprises injecting into the combustion chamber of the engine a liquid hydrocarbon fuel containing an amount effective to improve the cetane number of said fuel of at least one ignition accelerator compound of the formula:

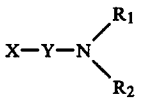

wherein X is an alkyl or alkylene (having one olefinic bond) group having one to six carbon atoms which can be normal, branched or cyclic; or an S-alkyl sulfenyl (R'—S—) where R' is an alkyl group having from one to six carbon atoms which can be normal, branched or cyclic chain; or a phenyl or p-tolyl group, $R_1$ and $R_2$ are independently selected from alkyl groups having one to six carbon atoms which can be normal, branched or cyclic; or a single R group joined together to form a saturated $C_5N$ ring; or $R_1$ can be nitroso and $R_2$ can be an alkyl having from 1 to 3 carbon atoms, Y is an $SO_2$ or a SC:S group.

2. A method according to claim 1 where said amount of said ignition accelerator compound in said fuel ranges from about 0.01 to about 2 wt.%.

3. A method according to claim 1 where said ignition accelerator compound is a N,N-dialkyldithiocarbamate of the formula

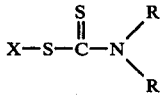

where R is an alkyl group of one to six carbon atoms which can be normal, branched or cyclic; or 2 R groups joined together to form a $C_5N$ saturated ring and X is an alkyl or alkylene (having one olefinic bond) group having one to six carbon atoms which can be normal, branched or cyclic; or an S-alkyl sulfenyl (R'—S—) where R' is an alkyl group having from one to six carbon atoms which can be normal, branched or cyclic.

4. A method according to claim 1 where said ignition accelerator compound is a N-alkyl-N-nitrosoarylsulfonamide of the formula

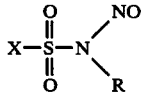

where R is an alkyl group having one to three carbon atoms and X is a phenyl or p-tolyl group.

5. A method according to claim 3 where said ignition accelerator compound is allyl-N,N-dimethyldithiocarbamate.

6. A method according to claim 3 where said ignition accelerator compound is t-butylsulfenyldimethyldithiocarbamate.

7. A method according to claim 4 where said ignition accelerator compound is n-methyl-n-nitroso-p-toluenesulfonamide.

8. A fuel for compression ignition engines comprising a diesel hydrocarbon oil stock containing an amount effective to improve the cetane number of said diesel hydrocarbon oil stock of at least one ignition accelerator compound of the formula

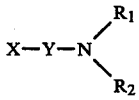

wherein X is an alkyl or alkylene (having one olefinic bond) group having one to six carbon atoms which can be normal, branched or cyclic; or an S-alkyl sulfenyl (R'—S—) where R' is an alkyl group having from one to six carbon atoms which can be normal, branched or cyclic chain; or a phenyl or p-tolyl group, $R_1$ and $R_2$ are independently selected from alkyl groups having one to six carbon atoms which can be normal, branched or cyclic; or a single R group joined together to form a saturated $C_5N$ ring; or $R_1$ can be nitroso and $R_2$ can be an alkyl having from 1 to 3 carbon atoms, Y is an $SO_2$ or a SC:S group.

9. A fuel according to claim 8 wherein said oil stock is a gas oil boiling within the range of about 350° F. to about 750° F.

10. A fuel according to claim 8 wherein said amount of said ignition accelerator compound ranges from about 0.01 to about 2 wt. %.

11. A method for improving the cetane properties of a diesel fuel which comprises incorporating therein an amount effective to substantially improve the cetane number of said fuel of at least one ignition accelerator compound of the formula:

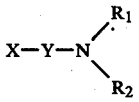

wherein X is an alkyl or alkylene (having one olefinic bond) group having one to six carbon atoms which can be normal, branched or cyclic; or an S-alkyl sulfenyl (R′—S—) where R′ is an alkyl group having from one to six carbon atoms which can be normal, branched or cyclic chain; or a phenyl or p-tolyl group, $R_1$ and $R_2$ are independently selected from alkyl groups having one to six carbon atoms which can be normal, branched or cyclic; or a single R group joined together to form a saturated $C_5N$ ring; or $R_1$ can be nitroso and $R_2$ can be an alkyl having from 1 to 3 carbon atoms, Y is an $SO_2$ or a SC:S group.

12. A fuel according to claim 11 wherein said amount of said ignition accelerator compound ranges from about 0.01 to about 2 wt. %.

* * * * *